US007333123B2

(12) United States Patent
Park

(10) Patent No.: US 7,333,123 B2
(45) Date of Patent: Feb. 19, 2008

(54) THERMAL TYPE IMAGE FORMING APPARATUS AND METHOD OF REMOVING JAMMED MEDIUM THEREFROM

(75) Inventor: Min-Su Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 206 days.

(21) Appl. No.: 11/178,492

(22) Filed: Jul. 12, 2005

(65) Prior Publication Data

US 2006/0033802 A1 Feb. 16, 2006

(51) Int. Cl.
*B41J 2/38* (2006.01)

(52) U.S. Cl. ..... 347/187

(58) Field of Classification Search ..... 347/222, 347/218, 187

See application file for complete search history.

(56) References Cited

U.S. PATENT DOCUMENTS

| | | | |
|---|---|---|---|
| 5,599,113 | A | 2/1997 | Suzuki et al. |
| 5,964,541 | A | 10/1999 | Murison et al. |
| 6,183,148 | B1 | 2/2001 | Martinez et al. |
| 2003/0125206 | A1 | 7/2003 | Bhatt et al. |

FOREIGN PATENT DOCUMENTS

| | | |
|---|---|---|
| EP | 0 806 297 | 11/1997 |
| EP | 1 024 013 | 8/2000 |
| EP | 1 550 559 | 7/2005 |
| JP | S60-255469 | 12/1985 |
| JP | H2-108574 | 4/1990 |
| JP | H3-166963 | 7/1991 |
| JP | H07-156501 | 6/1995 |
| JP | H10-16339 | 1/1998 |
| JP | H11-48507 | 2/1999 |
| JP | 2001-071606 | 3/2001 |
| JP | 2001-310503 | 11/2001 |
| JP | 2004 167970 | 6/2004 |

*Primary Examiner*—K. Feggins
(74) *Attorney, Agent, or Firm*—Roylance, Abrams, Berdo & Goodman, L.L.P.

(57) ABSTRACT

A thermal type image forming apparatus has a rotating cam which moves a thermal print head to a contact location. The rotating cam moves the thermal print head to contact locations so that the thermal print head contacts a platen roller at a first open location where the thermal print head is a first gap apart from the platen roller, and a second open location where the thermal print head is apart from the platen roller by a second gap which is greater than the first gap. In a method for removing jammed medium using the thermal type image forming apparatus, the thermal print head is placed at the first open location, and a transfer unit is driven to remove the jammed medium. If the removal of the jammed medium fails, the thermal print head is placed at the second open location.

12 Claims, 8 Drawing Sheets

THERMAL TYPE IMAGE FORMING APPARATUS AND METHOD OF REMOVING JAMMED MEDIUM THEREFROM

CROSS-REFERENCE TO RELATED APPLICATIONS

This application claims the benefit of Korean Patent Application No. 10-2004-0064222, filed on Aug. 16, 2004, the entire disclosure of which is hereby incorporated by reference.

BACKGROUND OF THE INVENTION

1. Field of the Invention

The present invention relates to an image forming apparatus and a jam removing method. More particularly, the present invention relates to a thermal type image forming apparatus which prints an image on a medium by heating the medium and a jammed medium removing method performed thereon.

2. Description of the Related Art

Thermal image forming apparatuses generally include a thermal printing head (TPH) and a platen which face each other while having a medium therebetween. The TPH prints an image, corresponding to image information, by applying heat to the medium. To effectively transfer the heat provided by the TPH, the TPH is elastically biased in a direction so as to contact the platen. The platen is generally a rubber roller. When the TPH presses down on the platen, the platen forms a nip, while being locally compressed. The medium receives heat from the TPH while passing through the nip. During printing, an elastic force of about 2 kilogram force (kgf) or more is applied to the TPH. When a jam of the medium occurs during printing, the jammed medium should be removed from the thermal image forming apparatus. To remove the jammed medium, the medium must be forcibly pulled from between the TPH and the platen. Consequently, the medium may rip. Moreover, the TPH or the platen may be damaged.

Accordingly, there is a need for an improved thermal image forming apparatus which automatically removes a jammed medium.

SUMMARY OF THE INVENTION

An aspect of the present invention is to solve at least the above problems and/or disadvantages and to provide at least the advantages described below. Accordingly, an aspect of the present invention is to provide a thermal type image forming apparatus capable of easily removing a jammed medium and a method of automatically removing a jammed medium from the image forming apparatus.

According to an aspect of the present invention, there is provided a thermal type image forming apparatus including a transfer unit for transferring a medium, a thermal print head for printing an image on the medium, a platen roller for supporting the medium while facing the thermal print head, and a rotating cam for moving the thermal print head to a contact location so that the thermal print head contacts the platen roller at a first open location where the thermal print head is a first gap apart from the platen roller and at a second open location where the thermal print head is apart from the platen roller by a second gap which is greater than the first gap.

The thermal print head may be located at first and second positions facing first and second surfaces of the medium, respectively. The thermal type image forming apparatus further includes support brackets rotatably coupled to the platen roller for rotatably supporting the thermal print head.

The rotating cam rotates the support brackets to locate the thermal print head at each of the first and second positions. The thermal type image forming apparatus also includes first and second engagement grooves formed in each of the support brackets. A locking member selectively engages with one of the first and second engagement grooves to lock the thermal print head at each of the first and second positions. The rotating cam rotates the thermal print head to the contact location and the first and second positions when the locking member is engaged with the first and second engagement grooves. The rotating cam rotates the support brackets to locate the thermal print head to the first and second positions when the locking member is disengaged from the first and second engagement grooves.

According to another aspect of the present invention, there is provided a method of removing a jammed medium using a thermal type image forming apparatus including a thermal print head capable of being placed at a contact location for contacting a platen roller at a first open location a first gap apart from the platen roller, and a second open location apart from the platen roller by a second gap which is greater than the first gap. A transfer unit transfers a medium. The method includes a step of placing a thermal print head at the first open location if the medium is jammed and driving the transfer unit to remove the jammed medium.

The method may further include a step of keeping the thermal print head at the first open location and waiting for a supply of a new medium if the jammed medium is successfully removed.

The method may further include a step of placing the thermal print head at the second open location if the removal of the jammed medium fails. The method may further include an operation of turning off the thermal type image forming apparatus after the thermal print head is placed at the second open location.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1A:
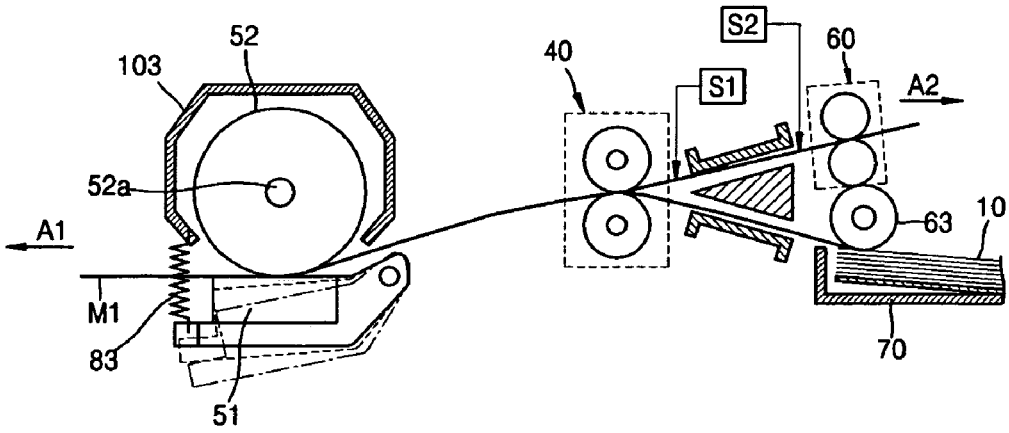
FIGS. 1A and 1B illustrate a schematic structure of a thermal image forming apparatus in accordance with an exemplary embodiment of the present invention.
Figure 1B:
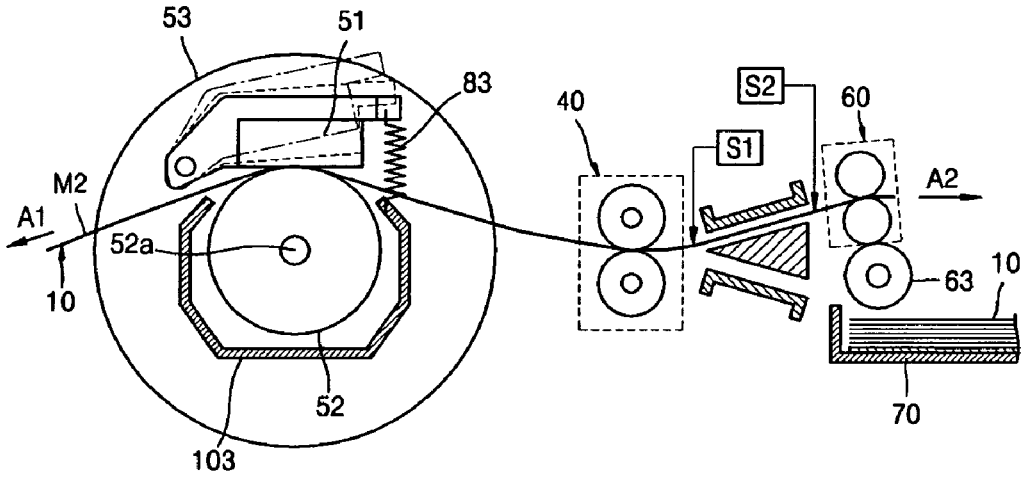

FIGS. 1A and 1B illustrate a schematic structure of a thermal image forming apparatus in accordance with an exemplary embodiment of the present invention. As illustrated in FIG. 1A, the thermal image forming apparatus includes a thermal printing head (TPH) 51 for forming an image by heating a medium 10. The thermal image forming apparatus also includes a platen roller 52 for supporting the medium 10 against the TPH 51. A transfer unit transfers the medium 10. The transfer unit includes a transfer roller 40 for transferring the medium 10 at a predetermined printing speed. The transfer unit may further include a discharge roller 60 for discharging the medium 10. The medium 10 is picked up from a supply cassette 70 by a pickup roller 63 and is transferred in a first direction Al by the transfer roller 40. The medium 10 is moved between the TPH 51 and the platen roller 52. When the medium 10 is located at a print start position, the transfer roller 40 starts transferring the medium 10 in a second direction A2. The TPH 51 heats the medium 10 to print an image on the medium 10. The discharge roller 60 discharges the medium 10 on which an image has been printed.

To perform double-sided printing, the TPH 51 can be moved to either a first position (illustrated in FIG. 1A) or a second position (illustrated in FIG. 1B), which face first and second surfaces M1 and M2, respectively, of the medium 10. The first surface M1 is opposite to the second surface M2. For example, the TPH 51 is rotated about a rotating shaft 52*a* of the platen roller 52 to move to either the first or second position. The TPH 51 is initially located at the first position. The medium 10 picked up from the supply cassette 70 by the pickup roller 63 and is transferred in the first direction Al by the transfer roller 40. The medium 10 is moved between the TPH 51 and the platen roller 52. At this time, the first surface M1 of the medium 10 faces the TPH 51. When the medium 10 is located at a print start position, the transfer roller 40 transfers the medium 10 in second direction A2. The TPH 51 prints an image on the first surface M1 of the medium 10 by heating the first surface M1. The discharge roller 60 temporarily discharges the medium 10 on which the first surface M1 has been printed with an image. When printing of an image on the first surface M1 of the medium 10 is complete, the transfer roller 40 and the discharge roller 60 stop operating. At this time, the medium 10 escapes from between the TPH 51 and the platen roller 52 and is positioned between the transfer roller 40 and the discharge roller 60. As illustrated in FIG. 1B, the TPH 51 is moved to the second position. The transfer roller 40 and the discharge roller 60 transfer the medium 10 in the first direction A1. Accordingly, the medium 10 is moved between the TPH 51 and the platen roller 52. The TPH 51 faces the second surface M2 of the medium 10. When the medium 10 is located at the print start position, the transfer roller 40 transfers the medium 10 in second direction A2. The TPH 51 prints an image on the second surface M2 of the medium 10 by heating the second surface M2. The discharge roller 60 discharges the medium 10 on which both surfaces have been printed with images.

For example, the TPH 51 may be rotated about the rotating shaft 52*a* of the platen roller 52 to move to the first or second position. While the transfer unit is transferring the medium 10 in the second direction A2, the TPH 51 is placed at contact locations (which are indicated by solid lines of FIGS. 1A and 1B) where the TPH 51 elastically contacts the platen roller 52. While the transfer unit is transferring the medium 10 in the first direction A1, the TPH 51 is moved to first open locations (which are indicated by dotted lines of FIGS. 1A and 1B), where the TPH 51 is a first gap apart from the platen roller 52. To remove a jammed medium, the TPH 51 is moved to second open locations (which are indicated by dashed-dot lines of FIGS. 1A and 1B), where the TPH 51 is apart from the platen roller 52 by a second gap which is greater than the first gap.

Figure 2:
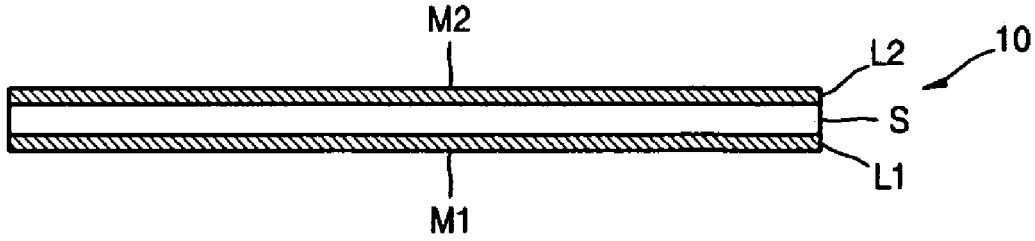
FIG. 2 is an exemplary cross-section of a medium.

The medium 10 used in the method of forming an image in accordance with an embodiment of the present invention may have a structure as illustrated in FIG. 2. Referring to FIG. 2, the medium 10 is produced by forming ink layers L1 and L2. On both surfaces of a base sheet S, which are first and second surfaces M1 and M2 of medium 10, ink layers L1 and L2 represent predetermined colors by reacting with heat. Each of the ink layers L1 and L2 may include a single layer for representing a single color, or multiple layers for representing 2 or more colors. For example, the ink layer L1 may be formed of two layers to express the colors yellow (Y) and magenta (M), and the ink layer L2 may be formed of a single layer to express the color cyan (C). Ink layer L1 selectively emits either the Y or M color depending on a temperature or a heating duration of the TPH 51. For example, if the TPH 51 heats the ink layer L1 at a high temperature for a short period of time, the Y color may be emitted. If the TPH 51 heats the ink layer L1 at a low temperature for a long period of time, the M color may be emitted. Of course, the opposite case is possible. If the base sheet S is transparent, when the ink layers L1 and L2 represent the Y, M, and C colors, the Y, M, and C colors overlap to represent a color image. The medium 10 having such a structure is disclosed in U.S. Patent Publication No. US2003/0125206.

On the other hand, if the base sheet S is opaque, double-sided printing is possible by printing different images on the first and second surfaces M1 and M2.

The structures of the ink layers L1 and L2 on the first and second surfaces M1 and M2 of the medium 10 are not intended to restrict the scope of the image forming method in accordance with exemplary embodiments of the present invention.

Figure 3:
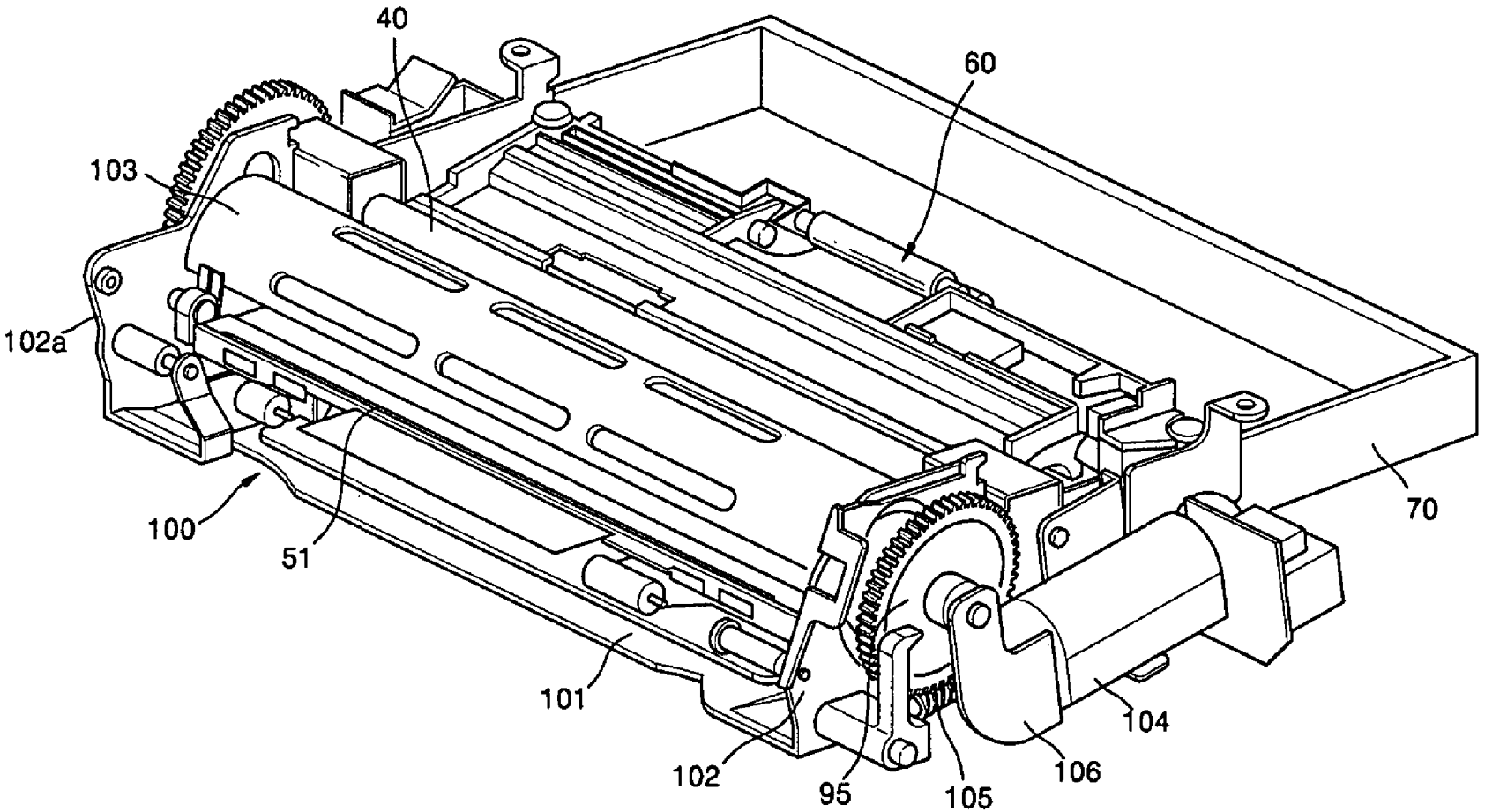
FIG. 3 is a perspective view of the thermal image forming apparatus in accordance with an exemplary embodiment of the present invention as shown in FIG. 1.
Figure 4:
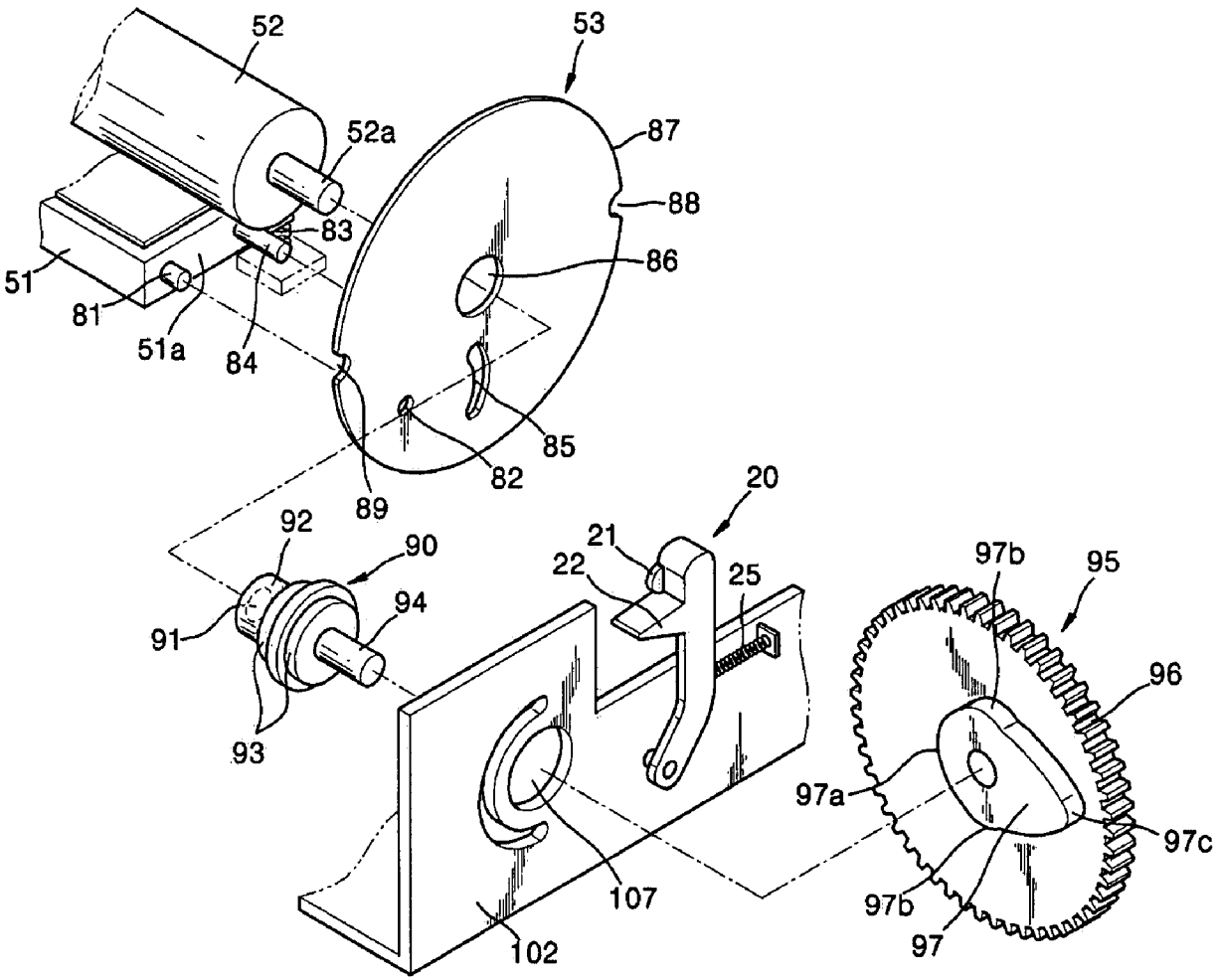
FIG. 4 is an exploded perspective view of a device for moving a thermal printing head (TPH) to contact locations and first and second open locations at first and second positions.

FIG. 3 is a perspective view of the thermal image forming apparatus shown in FIGS. 1A and 1B. FIG. 4 is an exploded perspective view of a device for moving the TPH 51 to the contact locations and the first and second open locations at the first and second positions.

Referring to FIGS. 3 and 4, a frame 100 includes a bottom base 101, and two lateral plates 102 and 102*a* extending up from both lateral sides of the bottom base 101. The supply cassette 70, in which the medium 10 is contained, is arranged on a side of the frame 100. The transfer roller 40, the discharge roller 60, and the pickup roller 63 (shown in FIGS. 1A and 1B) are supported by the two lateral plates 102 and 102*a* of the frame 100. The discharge roller 60 comes into contact with the pickup roller 63 and is driven by a single driving motor (not shown). The driving motor may be connected with the lateral plate 102*a*.

Referring to FIG. 4, the TPH 51 and the platen roller 52 are coupled to support brackets 53. A hinge shaft 81 formed on a lateral portion 51*a* of the TPH 51 is inserted into a hinge hole 82 formed in each of the support brackets 53 (only one of the support brackets 53 is shown in FIG. 4). The TPH 51 is rotated about the hinge hole 82 and placed at the contact location and the first and second open locations. The TPH 51 is elastically biased by an elastic member 83 in such a direction to contact the platen roller 52. As shown in FIGS. 1A and 1B, the elastic member 83 may be a tensile coil spring having one end connected to the TPH 51, and the other end connected to a cover 103 of FIGS. 1A and 1B, which covers the platen roller 52. The elastic member 83 preferably applies an elastic force of about 2 kgf to the TPH 51.

One end of a shaft 84 is also formed on the lateral portion 51*a* of the TPH 51, and the other end thereof is inserted into a through hole 85 formed in the support bracket 53. The through hole 85 is preferably in the shape of a slot along which the TPH 51 can move to the contact location and the first and second open locations. In the exemplary embodiment, the TPH 51 rotates about the hinge hole 82. Hence, the through hole 85 is preferably arcuately shaped around the hinge hole 82. The platen roller 52 is not connected to a driving motor (not shown). The platen roller 52 is independently rotated in contact with the medium 10 that is transferred by the transfer unit 40 and the discharge roller 60. Of course, the platen roller 52 may be connected to the driving motor (not shown) for rotation.

A bushing 90 includes an inner circumferential portion 91 and first, second, and third outer circumferential portions 92, 93, and 94, respectively, which are each concentric. A shaft 52*a* of the platen roller 52 is inserted into the inner circumferential portion 91. The first outer circumferential portion 92 is rotatably inserted into a through hole 86 of each of the support brackets 53. The second outer circumferential portion 92 is inserted into a hole 107 formed in each of the lateral sides 102 so that a bushing 90 is combined with each of the lateral sides 102. The rotating cam 95 is rotatably combined with the third outer circumferential portion 94. The rotating cam 95 includes a gear portion 96 and a cam portion 97 for pushing the shaft 84. The cam portion 97 includes first, second, and third cam portions 97*a*, 97*b*, and 97*c* corresponding to the contact location and the first and second open locations of the TPH 51, respectively. Referring to FIG. 3, a motor 104 has a worm gear 105 which engages with the gear portion 96. A bracket 106, to which the motor 104 is coupled, is combined with the lateral side 102. The second outer circumferential portion 93 of the bushing 90 is inserted into a hole 107 formed in each of the lateral sides 102, and the end of the third outer circumferential portion 94 of the bushing 90 is supported by the bracket 106. The bracket 106 prevents the rotating cams 95 from being detached from the third outer circumferential portions 94 at each lateral side 102. According to this structure, the platen roller 52, the support brackets 53, and the rotating cam 95 are rotated about the same rotating axis. The support bracket 53 has a circular circumference 87. First and second engagement grooves 88 and 89 are formed and separated from each other by 180 degrees along the circumference 87. A locking member 20 is rotatably combined with the lateral side 102. An elastic member 25 applies an elastic force to the locking member 20 in a direction so that the locking member 20 can engage with the first or second engagement groove 88 or 89. The locking member 20 releases from the first and second engagement grooves 88 and 89 by the rotating cam 95, and engages with the first or second engagement grooves 88 or 89 by the elastic force of the elastic member 25. The locking member 20 includes a protrusion 21, which is inserted into the first or second engagement grooves 88 or 89, and an interfering portion 22, which interferes with the cam portion 97 of the rotating cam 95.

FIGS. 5A through 5H illustrate a rotation of the TPH 51 and a movement of the TPH 51 to the contact locations and the first and second open locations in the first and second locations.

Figure 5A:
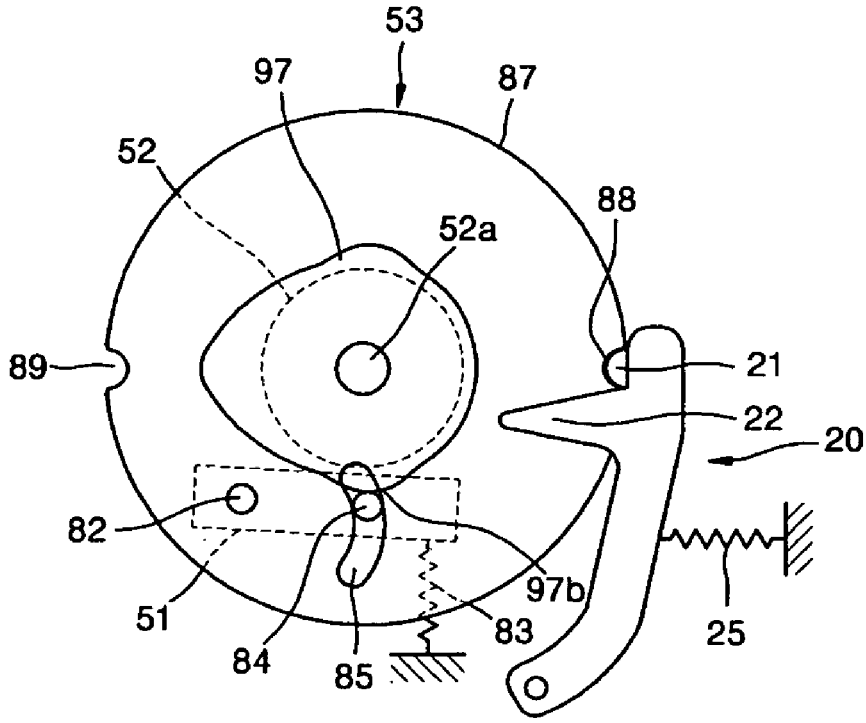
FIGS. 5A through 5H illustrate a method of moving the TPH to the contact locations and the first and second open locations in the first and second positions.

As shown in FIG. 5A, the shaft 84 contacts the second cam portion 97*b*. Accordingly, the TPH 51 is placed in the first open location, and is spaced a first gap apart from the platen roller 52. The protrusion 21 of the locking member 20 engages with the first engagement groove 88, so that the TPH 51 is locked at the first position. The medium 10, withdrawn from the supply cassette 70 by the pickup roller 63, is transferred to the first gap between the TPH 51 and the platen roller 52. The transfer roller 40 stops when the medium 10 reaches the print start position.

Figure 5B:
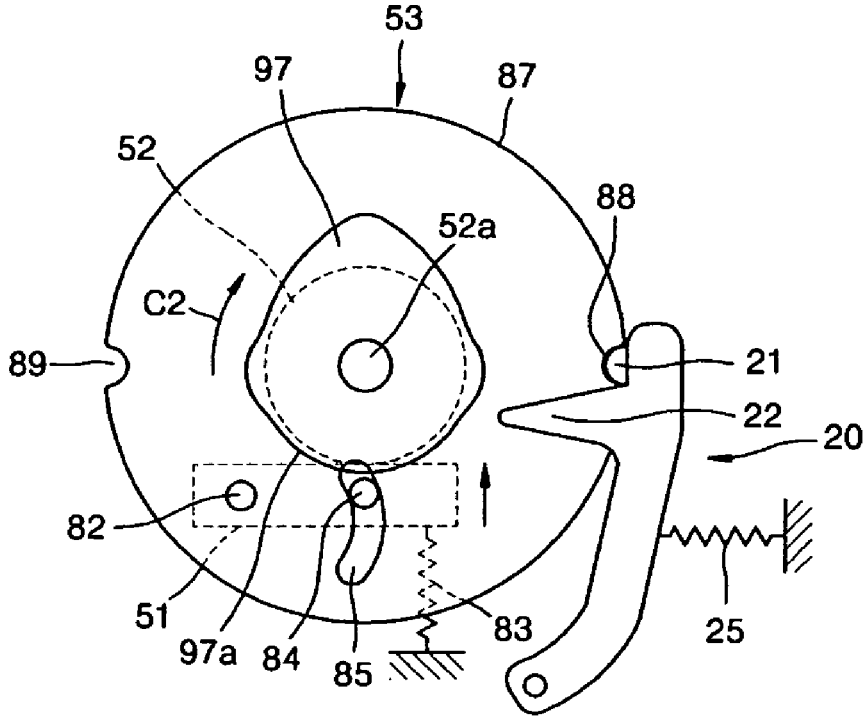

Referring to FIG. 5B, the rotating cam 95 is rotated in direction C2. Because the protrusion 21 of the locking member 20 is engaged with the first engagement groove 88, rotation of each support bracket 53 is prevented. Accordingly, the shaft 84 faces the first cam portion 97*a*, and the TPH 51 is rotated about the hinge hole 82 by the elastic force of the elastic member 83 so as to be placed at the contact location elastically contacting the platen roller 52. At this time, the first cam portion 97*a* and the shaft 84 are preferably apart from each other. The transfer unit 40 transfers the medium 10 in the second direction A2 of FIG. 1A. The TPH 51 heats the first surface M1 of the medium 10 to print an image on the first surface M1. The discharge roller 60 temporarily discharges the medium 10 on which the first surface M1 has been printed with an image. When the image printing on the first surface M1 of the medium 10 is complete, the transfer roller 40 and the discharge roller 60 stop, with the medium 10 departing from between the TPH 51 and the platen roller 52 and moves to a position between the transfer roller 40 and the discharge roller 60.

Figure 5C:
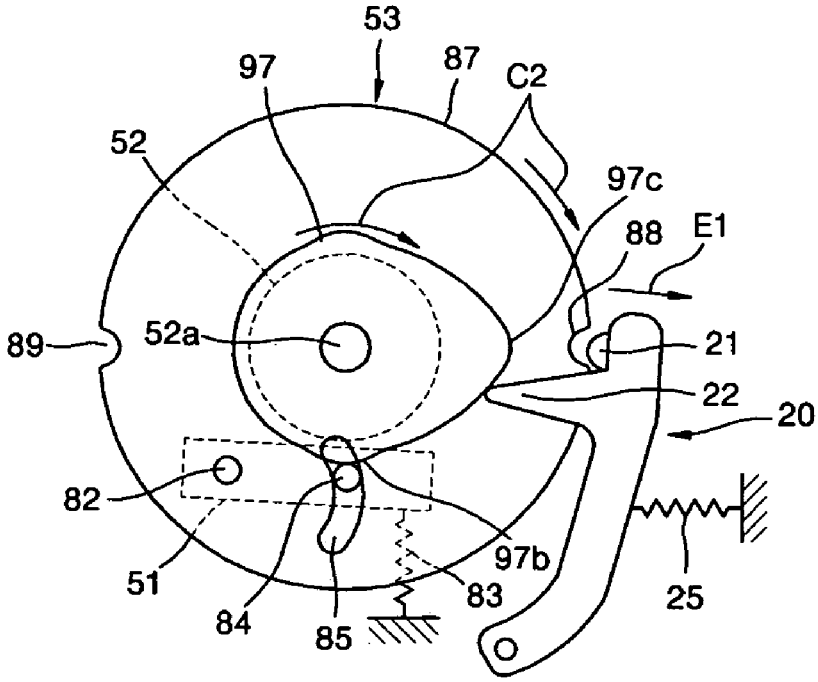
Figure 5D:
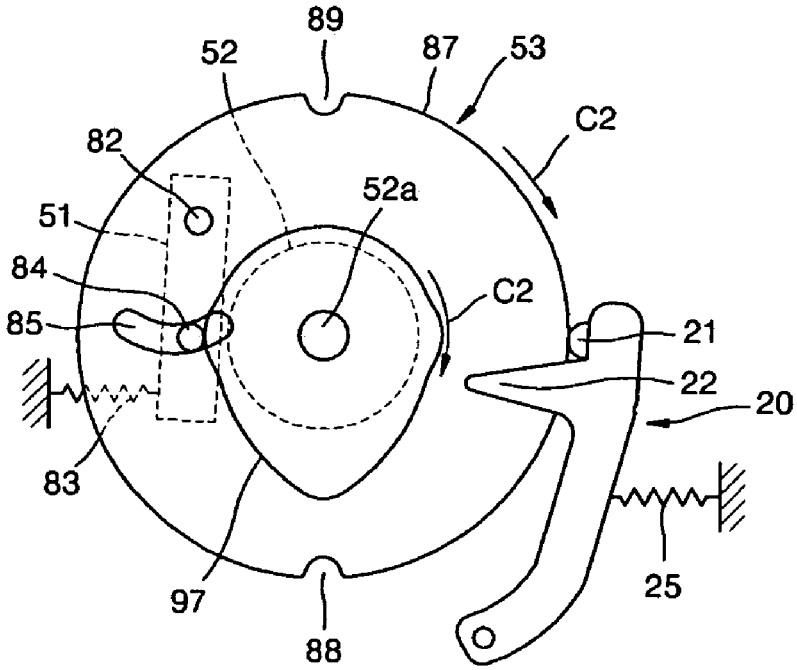
Figure 5E:
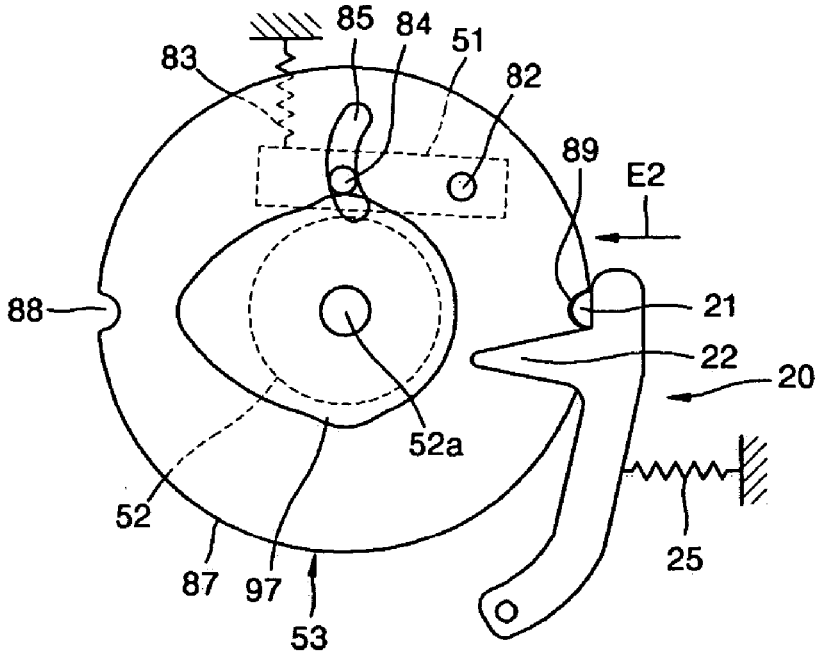

As shown in FIG. 1B, to print an image on the second surface M2 of the medium 10, the transfer of the TPH 51 to the second position is performed. Referring to FIG. 5C, when the rotating cam 95 is rotated in direction C2, the third cam portion 97*c* pushes the interfering portion 22 and rotates the locking member 20 in direction E1. Then, the protrusion 21 comes out of the first engagement groove 88 and releases each of the support brackets 53. Thus, the support brackets 53 can be freely rotated. Hence, when the rotating cam 95 continues to rotate in direction C2 and the cam portion 97*b* pushes the shaft 84, each of the support brackets 53 rotates in direction C2 as shown in FIG. 5D, instead of the TPH 51 separating from the platen roller 52. When contact between the third cam portion 97*c* and the interfering portion 22 ends, the locking member 20 continuously contacts the outer circumference 87 of each of the support brackets 53 due to an elastic force of the elastic member 25. As shown in FIG. 5E, when each of the support brackets 53 rotates 180 degrees, the locking member 20 rotates in direction E2 by an elastic force of the elastic member 25. Thus, the protrusion 21 is inserted into the second engagement groove 89 and each of the support brackets 53 is locked and can not be rotated further as the TPH 51 reaches the second position facing the second surface M2 of the medium 10. Also, the TPH 51 is placed at the first open location the first gap apart from the platen roller 52.

Figure 5F:
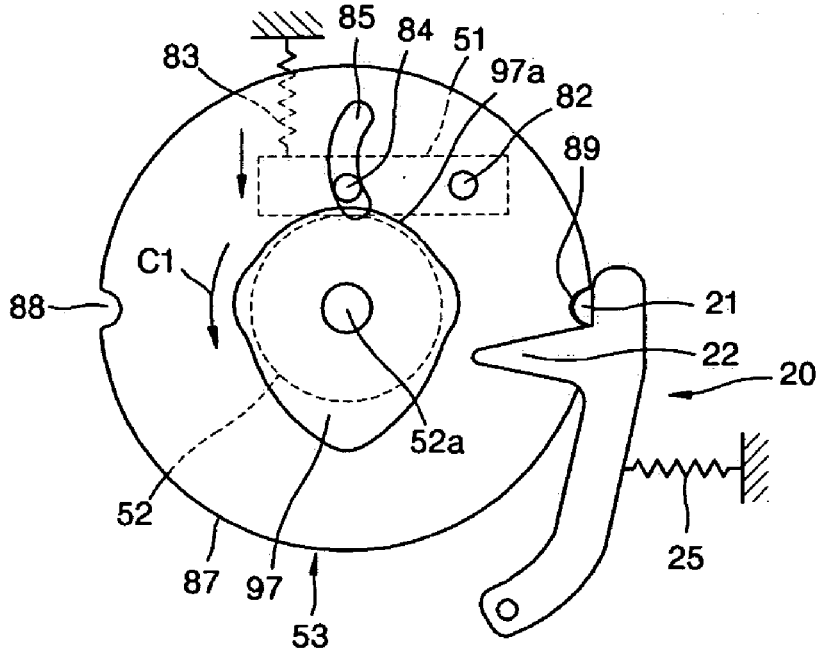

The transfer roller 40 and the discharge roller 60 transfer the medium 10 in the first direction A1. The medium is transferred to the first gap between the TPH 51 and the platen roller 52. When the medium 10 reaches the print start location, the transfer roller 40 and the discharge roller 60 stop transfer thereof . As shown in FIG. 5F, when the rotating cam 95 rotates in direction C1, rotation of each of the support brackets 53 is prevented from rotating because the protrusion 21 and engages with the second engagement groove 89. The shaft 84 faces the first cam portion 97*a* and the TPH 51 is rotated about the hinge hole 82 due to an elastic force of the elastic member 83. Moreover, TPH 51 is placed at the contact location elastically contacting the platen roller 52. Then, the second surface M2 of the medium 10 faces the TPH 51. At this time, the first cam portion 97*a* and the shaft 84 are preferably apart from each other. The transfer roller 40 transfers the medium 10 in the second direction A2. The TPH 51 heats the second surface M2 of the medium 10 to print an image on the second surface M2. The medium 10, having first and second surfaces M1 and M2 on which images have been printed, is then discharged from the image forming apparatus by the discharge roller 60.

When double-sided image printing is completed, the rotating cam 95 is rotated in direction C1. The third cam portion 97*c* pushes the interfering portion 22 to rotate the locking member 20 in direction E1. Then, the protrusion 21 is disengaged from the second engagement groove 89. Thus, each of the support brackets 53 can be freely rotated. When the second cam portion 97*b* pushes the shaft 84 due to continuous rotation of the rotating cam 95 in direction C1, each of the support brackets 53 is rotated in direction C1, instead of the TPH 51 being separated from the platen roller 52. When contact between the third cam portion 97*c* and the interfering portion 22 ends, the locking member 20 continuously contacts the outer circumference 87 of each of the support brackets 53 due to an elastic force of the elastic member 25. When each of the support brackets 53 rotates 180 degrees in direction C1, the locking member 20 is rotated in direction E2 by an elastic force of the elastic member 25, so that the protrusion 21 is inserted into the first engagement groove 88. Each of the support brackets 53 is locked and further rotation is prevented as the TPH 51 returns back to the first position as shown in FIG. 5A.

During this printing, medium jams may occur. As shown in FIGS. 1A and 1B, sensors S1 and S2 are arranged for detecting the medium 10. When the medium 10 is detected, the first and second sensors S1 and S2 are in the ON state. When no medium 10 is detected, the first and second sensors S1 and S2 are in the OFF state. Sensors S1 and S2 can control print start locations using an ON/OFF signal and can also detect medium jams. Information about positions of the TPH 51 in the printing stages, such as the first and second positions, the contact location, and the first and second open locations, is stored in a memory (not shown) during printing. Angles and directions at which the rotating cam 95 rotates to switch over the printing stages are calculated based on the stored information about the positions of the TPH 51. The location and number of sensors used may vary. It is apparent that the locations and the number of sensors may be adequately changed by one of ordinary skill in the art with reference to the present specification as long as the sensors can locate the medium 10 at a print start position and detect medium jams.

When the medium 10 is withdrawn from the feeding cassette 70 by the pickup roller 63 and reaches the transfer roller 40, the sensor S1 enters into an ON state. When the transfer roller 40 transfers the medium 10 by a predetermined distance in the first direction A1, the medium 10 is located at the print start position. The TPH 51 prints an image on the first surface M1 of the medium 10 while the transfer roller 40 transfers the medium 10 in the second direction A2. In this case, as shown in FIG. 5B, when the sensor S2 does not enter into an ON state within a predetermined period of time, it means that a medium jam occurred while an image was being printed on the first surface M1 of the medium 10. After an image is printed on the first surface M1 of the medium 10, the TPH 51 is located at the second position. The transfer roller 40 and the discharge roller 60 transfer the medium 10 by a predetermined distance in the first direction A1 so that the medium 10 is located at the print start position. In this case, as shown in FIG. 5E, when the sensor S2 is not switched off within a predetermined period of time, it means that a medium jam occurred while the medium 10 was being transferred to the print start position to print an image on the second surface M2 of the medium 10. When the TPH 51 is located at the printing start position, the transfer roller 40 transfers the medium in the second direction A2, and the TPH 51 prints an image on the second surface M2 of the medium 10. In this case, as shown in FIG. 5F, when the sensor S2 is not switched on within a predetermined period of time, it means that a medium jam occurred while an image was being printed on the second surface M2 of the medium 10. In this case, as shown in FIG. 5F, if the sensors S1 and S2 are not switched off within a predetermined period of time, it means that a medium 10 jam occurred while the medium 10 on which the first and second surfaces M1 and M2 have been completely printed with images are being discharged.

A method of removing a jammed medium 10 will now be described. When medium 10 jam occurs, it is convenient for users if the jam can be automatically removed instead of the user personally removing the jam. A method of removing a jammed medium 10 in accordance with exemplary embodiments of the present invention includes an operation for automatically removing the jammed medium 10. If the TPH 51 and the platen roller 52 contact with each other while removing the medium 10, the removal of the medium 10 is very difficult. In the method of removing the jammed medium, first, the TPH 51 is moved to the first open location so as to be separated from the platen 52.

As shown in FIG. 5B, the protrusion 21 of the locking member 20 is engaged with the first engagement groove 88 of the support bracket 53, such that the TPH 51 is locked at the first position. Also, the TPH 51 is placed at the contact location to contact with the platen roller 52. In this state, when the rotating cam 95 is rotated 90 degrees in direction C1, the second cam portion 97*b* pushes the shaft 84 so that the TPH 51 is placed at the first open location to be the first gap apart from the platen roller 52 as shown in FIG. 5A. As shown in FIG. 5E, the protrusion 21 of the locking member 20 is engaged with the second engagement groove 89 of the support bracket 53, such that the TPH 51 is locked at the second position. Also, the TPH 51 is placed at the second open location to be the first gap apart from the platen roller 52 as shown in FIG. 5E. As shown in FIG. 5F, the protrusion 21 of the locking member 20 engages with the second engagement groove 89 of the support bracket 53, so that the TPH 51 is locked at the second position. Also, the TPH 51 is placed at the contact location to contact with the platen roller 52. In this state, when the rotating cam 95 rotates 90 degrees in direction C2, the second cam portion 97*b* pushes the shaft 84 so that the TPH 51 is placed at the first open location the first gap apart from the platen roller 52 as shown in FIG. 5E.

Then, the transfer roller 40 and the discharge roller 60 are rotated in the second direction A2 so that the medium 10 can be automatically removed. At this time, when the sensors S1 and S2 are both switched off, it is determined if the removal of the medium 10 is complete. When the removal of medium 10 is complete, TPH 51 then returns to the state shown in FIG. 5A.

Figure 5G:
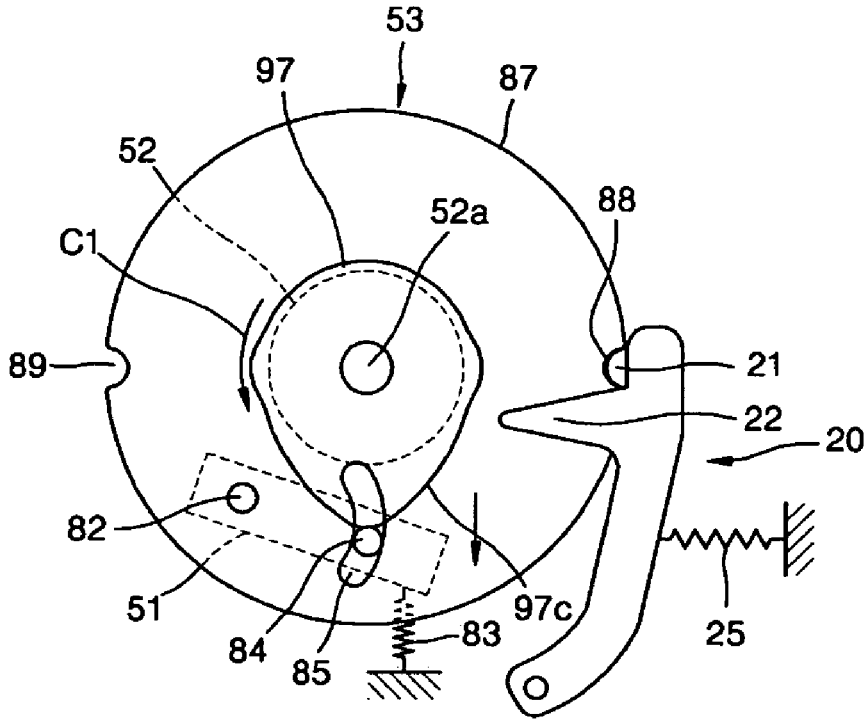
Figure 5H:
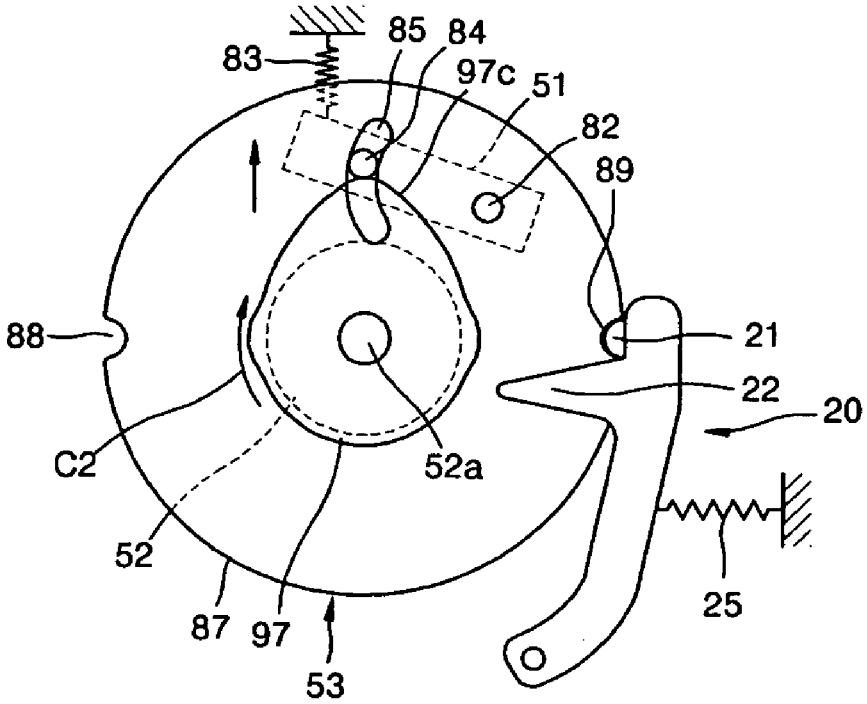

If any of the sensors S1 and S2 keeps an ON state instead of being switched off, it is determined that the removal of the medium 10 failed. This case denotes occurrence of medium jams that are too serious for automatic removal. In this case, a user should personally remove the jammed medium 10. In the jam removing method according to the present invention, the TPH 51 is rotated to be placed at the second open location to facilitate the jam removal by the user. As shown in FIG. 5B, the rotating cam 95 rotates 90 degrees in direction C1. Then, as shown in FIG. 5G, the third cam portion 97*c* pushes the shaft 84, so that the TPH 51 is placed at the second open location a second gap apart from the platen roller 52. In FIGS. 5E and 5F, the rotating cam 95 rotates 90 degrees in direction C2. Then, as shown in FIG. 5H, the third cam portion 97*c* pushes the shaft 84, so that the TPH 51 is placed at the second open location the second gap apart from the platen roller 52. In this state, the user is informed of occurrence of a medium jam by making an alarm sound or using a visual display device, such as, a light emitting device (LED) or a liquid crystal display (LCD). Also, for user safety, the power of the image forming apparatus is turned off. Hence, the user can more easily remove the jammed medium 10 by separating the TPH 51 from the platen roller 52 as much as possible. Furthermore, damage to the TPH 51 and the platen roller 52 during the removal of a jammed medium 10 can be reduced.

The embodiment illustrated in FIGS. 3, 4, and 5A through 5H relates to an image forming apparatus capable of performing double-sided printing by using the TPH 51 having first and second positions. If the TPH 51 can be located at only the first position as shown in FIG. 1A, the hinge hole 82, into which the hinge shaft 81 of the TPH 51 is inserted, and the through hole 85, into which the shaft 84 is inserted, may be formed on both lateral plates 102 and 102*a* of the frame 100. In this case, the locking level 20 is not necessary.

As described above, in the thermal type image forming apparatus in accordance with exemplary embodiments of the present invention, a TPH can be placed at a contact location to perform printing, at a first open location to achieve automatic medium jam removal, and at a second open location to achieve manual jam medium removal. To achieve double-sided printing, the TPH can also be located at first and second positions corresponding to first and second surfaces, respectively, of a medium.

A jam removing method performed by an image forming apparatus in accordance with exemplary embodiments of the present invention includes an operation of automatically removing a jammed medium, thus improving user convenience. When an automatic jam removal fails, medium jams can be manually removed by a user. In this case, by separating the TPH from a platen roller as far as possible, the manual jam removal can be easily achieved, and possible damage to the TPH or the platen roller can be minimized.

While the present invention has been particularly shown and described with reference to exemplary embodiments thereof, it will be understood by those of ordinary skill in the art that various changes in form and details may be made therein without departing from the spirit and scope of the exemplary embodiments of the present invention as defined by the appended claims.

What is claimed is:

1. A thermal type image forming apparatus comprising:

a transfer unit for transferring a medium;

a thermal print head for printing an image on the medium;

a platen roller for supporting the medium while facing the thermal print head; and a rotating cam for moving the thermal print head to a contact location so that the thermal print head contacts the platen roller, to a first open location where the thermal print head is a first gap apart from the platen roller, and a second open location where the thermal print head is apart from the platen roller by a second gap which is greater than the first gap.

2. The thermal type image forming apparatus of claim 1, wherein the thermal print head is located at first and second positions facing first and second surfaces, respectively, of the medium, which face each other.

3. The thermal type image forming apparatus of claim 2, further comprising support brackets rotatably coupled to the platen roller for rotatably supporting the thermal print head, wherein the rotating cam rotates the support brackets to locate the thermal print head at each of the first and second positions.

4. The thermal type image forming apparatus of claim 3, further comprising:

first and second engagement grooves formed in each of the support brackets; and a locking member for selectively engaging with one of the first and second engagement grooves, locking the thermal print head at each of the first and second positions, wherein the rotating cam rotates the thermal print head to the contact location and the first and second positions when the locking member is engaged with the first and second engagement grooves, and the rotating cam rotates the support brackets to locate the thermal print head to the first and second positions when the locking member is disengaged from the first and second engagement grooves.

5. A thermal type image forming apparatus comprising:

a transfer unit for transferring a medium;

a thermal print head for printing an image on the medium;

a platen roller for supporting the medium while facing the thermal print head, the platen roller having support brackets rotatably coupled thereto for rotatably supporting the thermal print head; and a rotating cam for moving the thermal print head to a contact location so that the thermal print head contacts the platen roller, to a first open location where the thermal print head is a first gap apart from the platen roller, and a second open location where the thermal print head is apart from the platen roller by a second gap which is greater than the first gap.

6. The thermal type image forming apparatus of claim 5, wherein the thermal print head is located at first and second positions facing first and second surfaces, respectively, of the medium, which face each other.

7. The thermal type image forming apparatus of claim 6, wherein the rotating cam rotates the support brackets to locate the thermal print head at each of the first and second positions.

8. The thermal type image forming apparatus of claim 7, further comprising:

first and second engagement grooves formed in each of the support brackets; and a locking member for selectively engaging with one of the first and second engagement grooves, locking the thermal print head at each of the first and second positions, wherein the rotating cam rotates the thermal print head to the contact location and the first and second positions when the locking member is engaged with the first and second engagement grooves, and the rotating cam rotates the support brackets to locate the thermal print head to the first and second positions when the locking member is disengaged from the first and second engagement grooves.

9. A method of removing a jammed medium using a thermal type image forming apparatus including a thermal print head capable of being placed at a contact location contacting a platen roller at a first open location a first gap apart from the platen roller, and a second open location apart from the platen roller by a second gap which is greater than the first gap, and a transfer unit transferring a medium, the method comprising the step of:

placing a thermal print head at the first open location if the medium is jammed and driving the transfer unit to remove the jammed medium.

10. The method of claim 9, further comprising the step of, keeping the thermal print head at the first open location and waiting for a supply of a new medium if the jammed medium is successfully removed.

11. The method of claim 9, further comprising the step of, placing the thermal print head at the second open location if the removal of the jammed medium fails.

12. The method of claim 11, further comprising the step of, turning off the thermal type image forming apparatus after the thermal print head is placed at the second open location.

* * * * *